United States Patent [19]

Prokop

[11] Patent Number: 4,682,136

[45] Date of Patent: Jul. 21, 1987

[54] FUSED COVERING FOR AN ELECTRICAL CONDUCTOR AND METHOD FOR MAKING THE FUSED COVERING

[75] Inventor: Raymond A. Prokop, Ingleside, Ill.

[73] Assignee: United Technologies Automotive, Inc., Dearborn, Mich.

[21] Appl. No.: 801,724

[22] Filed: Nov. 26, 1985

[51] Int. Cl.[4] ..... H01F 5/00

[52] U.S. Cl. ..... 335/282; 335/299; 29/602 R

[58] Field of Search ..... 335/251, 255, 260, 278, 335/282, 299; 251/129.01, 129.21; 29/602 R; 336/96

[56] References Cited

U.S. PATENT DOCUMENTS

| | | | |
|---|---|---|---|
| 2,829,860 | 4/1958 | Garner et al. | 251/129 |
| 2,934,090 | 4/1960 | Kenann et al. | 137/625.5 |
| 3,226,606 | 12/1965 | Erickson | 335/260 |
| 3,331,042 | 7/1967 | Erickson et al. | 335/260 |
| 3,451,021 | 6/1969 | Atherton | 335/260 |
| 3,661,183 | 5/1972 | Komaroff et al. | 137/625.65 |
| 4,120,481 | 10/1978 | von Koch | 251/129 |
| 4,236,131 | 11/1980 | Grandclement | 335/260 |
| 4,250,922 | 2/1981 | Will et al. | 137/625.65 |
| 4,538,645 | 9/1985 | Perach | 137/625.65 |

*Primary Examiner*—George Harris

*Attorney, Agent, or Firm*—Gene D. Fleischhauer

[57] ABSTRACT

An electrical apparatus, such as a solenoid assembly 10, and a method for making the solenoid assembly are disclosed. Various construction details which improve the integrity of the solenoid assembly against the leakage of fluids are disclosed. In one embodiment, the solenoid assembly has a first wall, such as a flange 14, which is substantially fused about the wall to a second wall, such as an encapsulating casing 18.

18 Claims, 5 Drawing Figures

FUSED COVERING FOR AN ELECTRICAL CONDUCTOR AND METHOD FOR MAKING THE FUSED COVERING

TECHNICAL FIELD

This invention relates to a container for an electrical apparatus and the seal between the walls of the container. The invention was developed in the field of electromagnetically operated solenoid valves, but the teachings herein are applicable to other electrical apparatuses.

BACKGROUND OF THE INVENTION

An example of an electromagnetically operated control valve is shown in U.S. Pat. No. 4,538,645 issued to Perach entitled "Control Valve Assembly" the assignee of which is a wholly owned subsidiary of the assignee of this invention. The control valve assembly includes a pair of valve seats and a poppet which is oscillated between the seats.

An electromagnet is provided to drive the poppet between the seats. The electromagnet includes a solenoid assembly and a spring loaded armature of magnetic material. The solenoid assembly has a non-magnetic form, commonly called a bobbin, in which the armature moves and a solenoid or coil of insulated wire wound around the bobbin and about the armature. An iron or steel casing, such as the shell 40, usually extends circumferentially about the solenoid. The casing increases the mechanical force of the plunger and concentrates the lines of flux of the magnetic field which is generated by energizing the coil.

Another example of a solenoid assembly is similar to the solenoid assembly shown in FIG. 1 of this application. This solenoid assembly has an outer steel casing and an inner plastic casing. An injection molded thermoplastic is used as an encapsulant to form the inner casing about the solenoid. The encapsulant is commonly either the same plastic as the bobbin or sometimes a dissimilar plastic.

The encapsulant overlaps either end of the flanges of the bobbin to provide a seal from the outside environment. As shown, the adjacent material or the flange might be recessed to provide for this overlap. The overlapped encapsulant provides a reasonable seal from the outside environment but not one that permits submergence of the solenoid assembly in a liquid or washing of the solenoid assembly with a high pressure stream of liquid as might occur during normal cleaning operations of a machine on which the solenoid is installed. Experience has also shown that cyclic variations in temperature tend to open a gap between the flanges of the bobbin and the encapsulant further decreasing the isolation of the interior of the coil from the outside environment.

Sealing the coil from the outside environment is important because contamination of the coil with water or other electrically conductive substances may degrade the performance of the coil by breaking down the insulation of the wire and even cause shorting of the coil to ground through the shell.

As a result, scientists and engineers are seeking to develop a solenoid assembly which can accept submersion of the coil in a liquid for a short period of time or the impact of a high pressure liquid stream without allowing the leakage of the fluid through the casing into the coil.

DISCLOSURE OF INVENTION

According to the present invention, a method for forming a seal for an electrical assembly having two walls includes the step of forming a seal lip on one wall which is contoured to partially melt as the second wall in molten form is disposed about the first wall and the step of disposing the second wall about the first wall in molten form.

In accordance with one embodiment of the present invention, a solenoid assembly includes a flange on a bobbin having a seal lip which extends from the flange and an encapsulant which is injection molded about the bobbin in molten form.

In accordance with one embodiment of the present invention, the seal lip extends circumferentially about the edge region of the flange and is substantially fused with the encapsulating casing to block the leakage of fluids between the flange and the casing.

A primary feature of the present invention is an electrical assembly having two walls. A seal lip extending circumferentially about one of the walls is substantially fused with the other wall. In one embodiment, the electrical assembly includes a solenoid wound on a bobbin and encapsulated in a thermoplastic material. The bobbin has a projecting seal lip which extends circumferentially about the flange and which is substantially fused with the encapsulating casing. In one detailed embodiment, the flange has an edge region having a step-like offset surface such that the flange has two outwardly facing radially stepped surfaces. Each surface carries a seal lip which extends circumferentially about the surface. In one embodiment, the axially innermost surface is interrupted over a portion of the circumference to aid in winding of the wire on the bobbin.

A principal advantage of the present invention is the service life of an electrical assembly which results from the structural integrity of the circumferential seal formed by substantially fusing the seal lip with an encapsulating casing. Another advantage is the submersible nature of the electrical assembly which results from the seal and its ability to tolerate the pressure of water across the seal for short periods of time. Another advantage is the integrity and durability of the seal in a solenoid assembly which enables the solenoid to withstand vibrations and exposure to ice and mud as well as high temperature conditions involving water such as might occur during steam cleaning of vehicles on which the coil is mounted.

The foregoing features and advantages of the present invention will become more apparent in light of the following detailed description of the best mode for carrying out the invention and in the accompanying drawings.

BEST MODE FOR CARRYING OUT THE INVENTION

Figure 1:
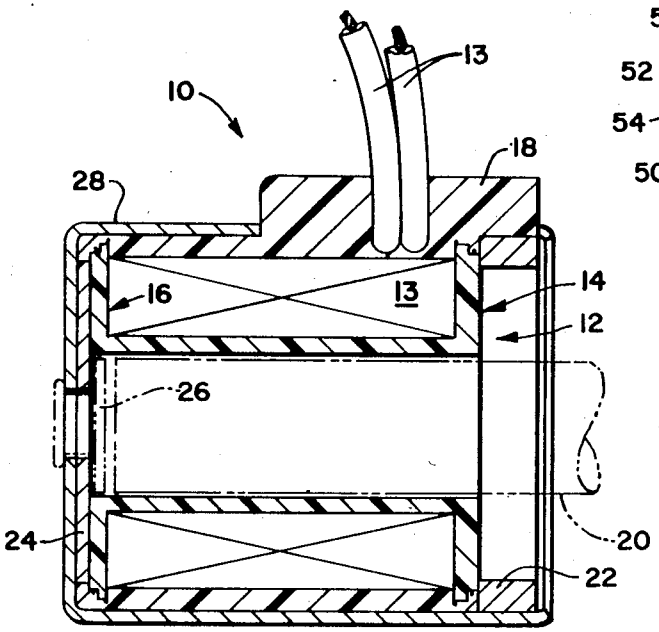
FIG. 1 is a cross-sectional view of a solenoid assembly showing the solenoid mounted on a bobbin and disposed within an encapsulating casing.

FIG. 1 is a solenoid assembly embodiment of the present invention. The solenoid assembly 10 includes a bobbin 12 extending circumferentially about an axis A and a solenoid 13 or coil of wire extending about the bobbin. The bobbin has a first flange 14 and a second flange 16 which extend circumferentially about the bobbin to keep the coil in place. A casing 18 extends axially between the first flange and the second flange and overlaps the flanges. The solenoid assembly may also include a core, such as the armature 20 shown in phantom, disposed in the bobbin to form an electromagnetic device. The armature may either engage the interior of the bobbin or a non-magnetic tubular insert which acts as a liner for the bobbin. Masses of magnetizable material, such as an adaptor 22, a washer 24, a stop 26 shown in phantom and a shell 28, are disposed about the solenoid to constrain the magnetic field and increase the mechanical force of the armature.

Figure 2:
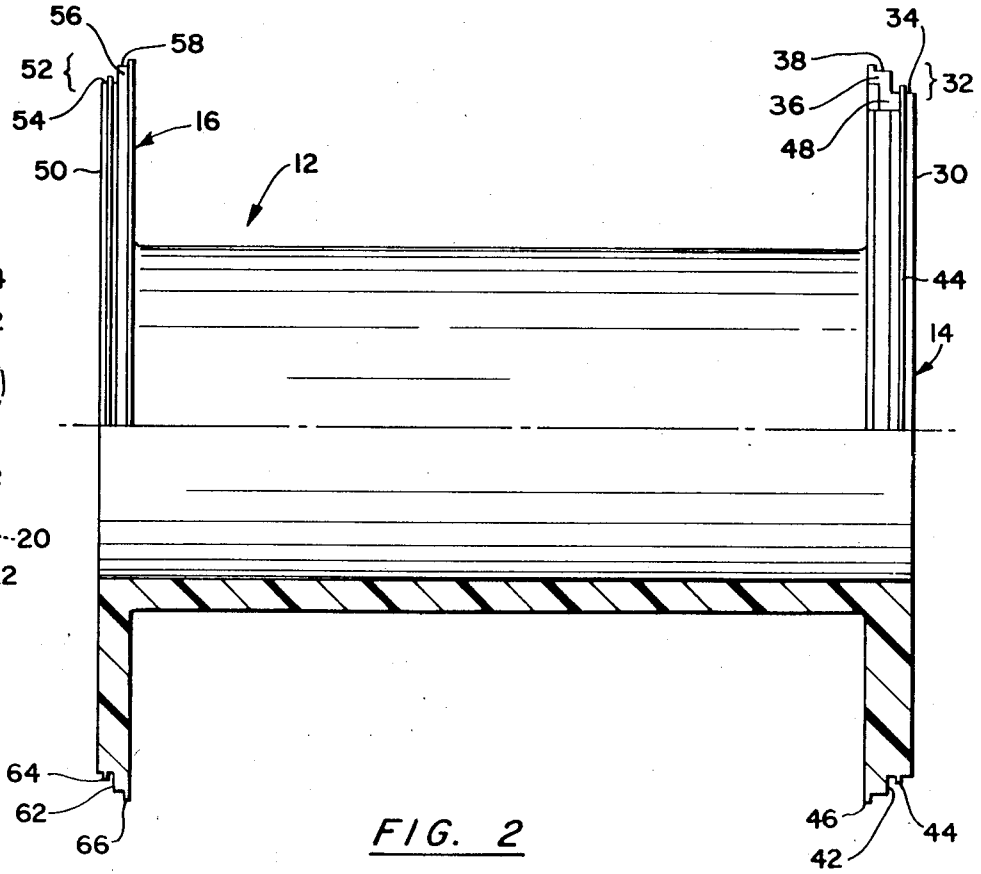
FIG. 2 is a side elevation view partly in section and partly in full showing the bobbin of FIG. 1.

FIG. 2 is an enlarged side elevation view of the bobbin 12 shown in FIG. 1 and is partly in section and partly in full. The first flange 14 has a side 30 and an edge region 32. The edge region has a first surface 34 which faces radially and extends axially and circumferentially about the flange. A step-like offset 36 forms a second surface 38 spaced radially from the first surface. The second surface 38 faces radially and extends axially and circumferentially about the flange. A third surface 42 faces axially and extends circumferentially about the flange and radially between the first and second surfaces. The edge region has a circumferentially continuous seal lip 44 which extends circumferentially about the edge region and from the first surface in the radial direction. The seal lip is continuous if there are no circumferential breaks in the seal lip greater than the width of the seal lip as measured parallel to the surface from which it projects, although breaks smaller than that are preferred, such as a break less than or equal to one-half of the width of the seal lip. Breaks greater than the width of the seal lip may be tolerated depending on the ability of the plume-like transition of fused material to provide sealing. A second seal lip 46 extends circumferentially about the edge region and is interrupted over a short distance by a loading slot 48 which extends circumferentially in the edge region for a distance less than ten percent (10%) of the radius from the axis of the bobbin to the edge region.

The second flange 16 has a side 50 and an edge region 52, a first surface 54, and a step-like offset 56. The step-like offset has a second surface 58. A third surface 62 extends circumferentially about the flange and radially between the first surface and the second surface. A circumferentially continuous seal lip 64 and a circumferentially continuous seal lip 66 extend circumferentially about the second flange.

Figure 3:
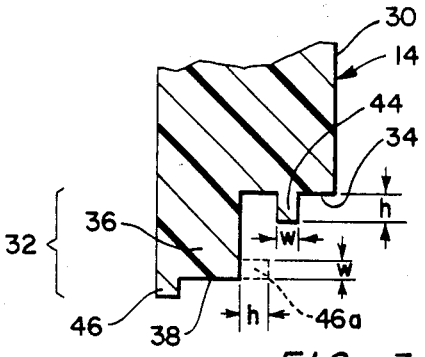
FIG. 3 is an enlarged view of the flange of the bobbin showing the circumferentially extending seal lips.

FIG. 3 is an enlarged view of the first flange 14 shown in FIG. 2. As shown by the broken lines, the second seal lip 46 might extend axially as does seal lip 46*a* from the axially facing third surface 42. All seal lips are large enough so that the seal lip is not broken during handling of the bobbin during manufacture, but small enough so that, at its location, it will partially melt when encapsulated by the molten casing. The size of the seal lip will vary with the strength of the material from which it is made, the thermal conductivity of the material and its specific heat. One satisfactory material used for the bobbin is Rynite 530 thermoplastic, a polyethylene terepethalate filled with thirty percent (30%) by volume fiberglass which is available from the E. I. DuPont de Nemours and Company, Inc., Polymer Products Department, Washington, Del. The fiberglass is added to strengthen the formulation and it is believed that any thermoplastic having proper characteristics might be used. Another suitable thermoplastic is Zytel nylon thermoplastic which is also available from the same source as Rynite 530 thermoplastic. As shown, the first continuous seal lip formed from the Rynite 530 thermoplastic protrudes a distance which is equal to or greater than ten (10) thousandths of an inch and as shown is fifteen (15) thousandths of an inch. Its width is no greater than fifteen (15) thousandths of an inch. Similarly, the second continuous seal lip protrudes for a distance of ten (10) thousandths of an inch and has a width of ten (10) thousandths of an inch. The seal lips on the second flange are similarly formed. The location of a seal lip may be near the center of the surface from which it extends, such as the first seal lip 44 extending from the center of the first surface 34, or near the edge of the surface, such as the second seal lip extending from the edge of the second surface 38. In one embodiment of the second flange, the seal lip on the first surface 54 was formed coincident with the side 50 of the second flange and the second seal lip was formed coincident with the inside of the flange.

Figure 4:
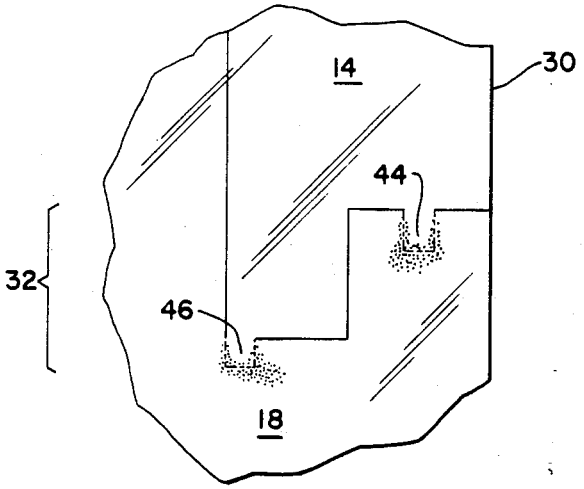
FIG. 4 is a line drawing of a portion of a solenoid assembly which has been physically cut to show the relationship of the substantially fused seal lip to the encapsulating material.
Figure 5:
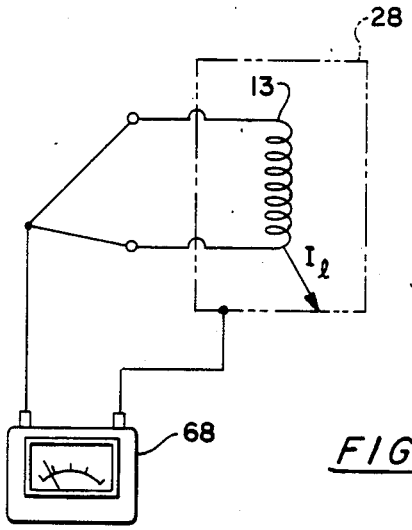
FIG. 5 is a schematic illustration of a device for determining the leakage current from the coil to the exterior of the solenoid assembly and thence to ground.

FIG. 4 is a line drawing of an actual section of a solenoid assembly cut perpendicular to the continuous seal lid 44 along a radial plane passing through the axis A of the bobbin 12 to show the relationship of the seal lips 44, 46 to the encapsulating casing 18 which results from the method for making the solenoid assembly. The method for making the solenoid assembly includes several steps. One step is forming a bobbin having a flange 14 extending circumferentially about the bobbin with an edge region 32 having the circumferentially continuous seal lip which extends from the flange about the circumference of the flange. After forming the bobbin, the solenoid or coil is formed by winding insulated wire on the bobbin. After winding the wire on the bobbin, the bobbin is placed in a mold. A plastic casing material which is compatible with, (that is, capable of fusing with) the bobbin material, is heated in a heating apparatus. The material is heated under pressure until the material is molten, that is, flowable from the heating apparatus to the mold.

One example of a material that is flowable and compatible with the bobbin material is the same material as the bobbin, Rynite 530 thermoplastic material, filled with thirty percent (30%) by volume of fiberglass material. Flowability of the filled thermoplastic material is increased by decreasing the fiberglass filling. In one embodiment, the fiberglass filling was decreased to thirteen percent (13%) by weight fiberglass with a slight decrease in the strength of the casing.

Other thermoplastic materials are thought to be compatible and even thermosetting plastics having a cure temperature which is not excessive have not been ruled out as compatible materials. Nevertheless, best results have been obtained using the same thermoplastic material for the bobbin and for the casing.

After heating the second thermoplastic material until it is molten, the second material is disposed about the bobbin. Each seal lip is contoured such that it melts because of the heat transferred to the seal lip from the molten material. As a result of the contour, at least a portion of the seal lip, but not all of the seal lip, melts and substantially fuses with the molten thermoplastic material which surrounds the seal lip. The contour and the heat transfer area of the seal lip may be adjusted for different materials to accommodate for changes in thermal conductivity of the bobbin material and thermal capacitance of the flange which supports the seal lip and for the thermal conductivity and thermal capacitance of the coil. The location of the seal lip also affects heat transfer through and away from the seal lip. For this reason, the seal lip is located in the edge region of the flanges to increase the thermal resistance through the flange to the coil material. As shown in FIG. 4, the seal lip has melted and fused with the surrounding or encapsulating casing material with the dots showing the plume-like transition from the seal lip material into the casing material. The plume-like transition also provides sealing for small local breaks in the continuous seal lip, although it is preferable to avoid such breaks. As a result, the flange is integrally joined with the casing. Complete melting of the seal lip is not desirable because the seal lip is then no longer part of the flange and the plume-like transition must be relied on for sealing at two locations rather than one location. Once substantial fusing has occurred between the seal lip and the casing, a solenoid assembly with the proper integrity has been formed. Simple tests exist to measure whether substantial fusing has taken place and the proper integrity established. One test is to heat the solenoid assembly to a temperature of fifty (50) degrees Celsius for two (2) hours and then immerse the solenoid assembly in a container of twenty-five (25) degrees Celsius tap water to a depth of one foot for two (2) hours. Immediately upon removal from the container, an insulation resistance tester 68 is used to apply an electrical potential of five hundred (500) volts direct current for sixty (60) seconds from both coil leads to the shell. The shell 28, through the adaptor 22 and washer 24, provides a path for any leakage current from the coil through the seal. A leakage current $I_1$ in excess of ten (10) microamperes is unacceptable and shows the presence of ionized water within the coil. It is believed that as the heated coil is immersed in the tap water, a partial vacuum can develop inside the casing as the casing cools down unless the seal lip has substantially fused with the casing around the circumference of the seal lip. If the encapsulant is not substantially fused to the bobbin, water will be drawn into the coil and reveals itself during the high potential test. All coils encapsulated with the design as shown in FIG. 4 passed this test. If preferred, a more severe test can use the voltage of one thousand (1,000) volts DC and a solenoid assembly temperature of one hundred (100) degrees Celsius or higher to determine if the coil can be exposed to much more severe conditions.

As a result of this process, an electrical assembly is produced which is submersible for short periods of time. Although submersible, the solenoid assembly is not designed for use as an underwater device. This enables the solenoid assembly to operate in conditions of high humidity, severe vibration, ice and mud because of the integral nature of the junction between the fused seal lip and encapsulant casing. Further evidence of the integral nature of the casing is the joint of the casing to the seal lip which requires breaking of the joint to separate the two parts. This sealing integrity is maintained under temperature gradients and in the presence of high pressure water such are used during the cleaning of heavy equipment and under normal operating conditions.

Although the invention has been shown and described with respect to detailed embodiments thereof, it should be understood by those skilled in the art that various changes in form and detail thereof may be made without departing from the spirit and the scope of the claimed invention.

I claim:

1. For an electrical assembly of the type having an electrical conductor disposed on the interior and a protective cover which includes a first wall and a second wall that engages the first wall, the improvement which comprises:

a first wall having a continuous seal lip extending from the wall, the lip having at least two surfaces in the uninstalled condition which are melted such that the lip is partially melted in the installed condition and is substantially fused with the second wall such that the leakage of fluids between the walls is blocked.

2. The electrical assembly as claimed in claim 1 wherein the first wall consists of a plastic material, the second wall consists of a plastic material and the walls are substantially fused by disposing the second wall in molten form about the first wall.

3. For a solenoid assembly of the type having a bobbin disposed about an axis, a wire wound about the bobbin, and a casing which extends circumferentially and axially about the bobbin to engage the bobbin, the improvement which comprises:

a bobbin having a flange extending circumferentially about the bobbin which engages the casing, the flange having a circumferentially continuous seal lip which extends from the flange, the lip having at least two surfaces in the uninstalled condition which are melted in the installed condition such that the lip is partially melted and is substantially fused with the casing about the circumference of the lip such that leakage of fluids between the flange and the casing is blocked under operative conditions.

4. The solenoid assembly as claimed in claim 3 wherein the flange has an edge region which engages the casing and the circumferentially continuous seal lip extends about the edge region.

5. The solenoid assembly of claim 4 wherein the edqe region of the flange further has a first surface which faces radially and which extends axially and circumferentially about the flange; a second surface which is spaced radially from the first surface, which faces radially and which extends axially and circumferentially about the flange; a third surface which faces axially and which extends radially between the first and second surfaces, and, wherein the continuous seal lip extends from one of said surfaces.

6. The solenoid assembly of claim 5 wherein the bobbin comprises a plastic material and the casing comprises a plastic material which is compatible with the plastic material of the bobbin and wherein the lip has a surface spaced by a distance from the surface of the edge region from which the lip extends, the distance being at least ten thousandths of an inch and the lip further having a width which is no greater than fifteen thousandths of an inch.

7. The solenoid assembly of claim 6 wherein the compatible plastic material is the plastic material of the bobbin.

8. The solenoid assembly of claims 1, 2, 3, 4, 5, 6 or 7 wherein the plastic material is a thermoplastic material.

9. The solenoid assembly of claim 5 wherein said lip is a first lip and wherein the solenoid assembly includes a second lip which extends from one of said remaining surfaces and circumferentially about the flange, the second lip being spaced from the first lip.

10. The solenoid assembly of claim 9 wherein the second lip is spaced radially and axially from the first lip and extends axially from the third surface.

11. The solenoid assembly of claim 9 wherein the second lip is spaced radially and axially from the first lip and extends radially from the second surface.

12. The solenoid assembly of claim 11 wherein the second lip is circumferentially interrupted.

13. The solenoid coil of claim 7 wherein the plastic material is a thermoplastic material consisting essentially of a thermoplastic material which is filled with a first amount of fiberglass material and wherein the compatible thermoplastic material which comprises the casing is filled with a second, lesser amount of fiberglass material.

14. A bobbin for a solenoid assembly of the type which is adapted to have a wire wound about the bobbin and a casing which extends circumferentially and axially about the bobbin to engage the bobbin, wherein the improvement comprises:

a bobbin having a melting point, having a flange which extends circumferentially about the bobbin and having an edge region on the flange which is adapted to engage the casing, the edge region having a step which projects radially from the flange and a seal lip which extends from the step of the flange, which extends circumferentially about the step of the flange, and which is contoured such that the surface of the seal lip will partially melt when surrounded by molten material at the melting point of the bobbin.

15. The bobbin of claim 14 wherein said seal lip is a second seal lip, the flange has a first outwardly facing surface which extends circumferentially about the flange, and a first seal lip which extends circumferentially about the first surface, and wherein the step extends radially from the first outwardly facing surface of the flange and has a second outwardly facing surface which is spaced radially from the outwardly facing surface of the flange, and wherein the second seal lip extends radially from the second outwardly facing surface of the step.

16. The bobbin of claim 15 wherein the first seal lip and the second seal lip are circumferentially continuous.

17. A method for forming a solenoid coil of the type having a bobbin disposed about an axis, a wire wound about the bobbin, and a casing which is molded about the wire wound bobbin, including the steps of:

forming a bobbin which comprises a plastic material, the bobbin having a flange extending circumferentially about the bobbin and an edge region on the flange which is adapted to engage the casing, the edge region having a circumferentially continuous seal lip which extends from the flange about the circumference of the flange, the lip having at least two surfaces;

disposing a coil of wire about the bobbin; heating a thermoplastic material which is compatible with the thermoplastic material to a temperature at which the heated thermoplastic material is molten;

disposing the molten thermoplastic material about the bobbin to form a casing and to enable substantial fusing of the molten material with the seal lip by melting the surfaces such that the lip is partially melted; and, cooling the material to solidify the molten thermoplastic material and cause the continuous seal lip to substantially fuse with the casing about the circumference of the ring such that the leakage of fluid between the bobbin and the shell is blocked.

18. The method for forming a solenoid coil of claim 17 wherein the step of disposing the molten thermoplastic material about the bobbin includes the step of disposing the bobbin in a die and injecting an amount of molten thermoplastic material into the die about the bobbin.

* * * * *